United States Patent [19]

Winterbotham

[11] Patent Number: 4,734,223

[45] Date of Patent: Mar. 29, 1988

[54] DETERGENT COMPOSITIONS

[75] Inventor: Peter Winterbotham, Merseyside, United Kingdom

[73] Assignee: Lever Brothers Company, New York, N.Y.

[21] Appl. No.: 5,365

[22] Filed: Jan. 14, 1987

Related U.S. Application Data

[63] Continuation of Ser. No. 727,498, Apr. 26, 1985, abandoned.

[30] Foreign Application Priority Data

May 11, 1984 [GB] United Kingdom ..... 8412045

[51] Int. Cl.[4] ..... C11D 1/29; C11D 1/37; C11D 3/43; C11D 17/08

[52] U.S. Cl. ..... 252/548; 252/153; 252/173; 252/551; 252/552; 252/557; 252/DIG. 14

[58] Field of Search ..... 252/153, 173, 548, 551, 252/552, 557, DIG. 13, DIG. 14

[56] References Cited

U.S. PATENT DOCUMENTS

| | | | |
|---|---|---|---|
| 3,919,125 | 11/1975 | Ashina | 252/551 |
| 4,072,632 | 2/1978 | Reed | 252/541 |
| 4,243,549 | 1/1981 | Messenger | 252/153 |

FOREIGN PATENT DOCUMENTS

| | | |
|---|---|---|
| 140710 | 5/1985 | European Pat. Off. . |
| 1429637 | 3/1976 | United Kingdom . |
| 1437095 | 5/1976 | United Kingdom . |
| 2021141 | 11/1979 | United Kingdom . |
| 2105325 | 3/1983 | United Kingdom . |
| 2104913 | 3/1983 | United Kingdom . |
| 2108520 | 5/1983 | United Kingdom . |
| 2130238 | 5/1984 | United Kingdom . |
| 2130236 | 5/1984 | United Kingdom . |
| 2133793 | 8/1984 | United Kingdom . |

*Primary Examiner*—Dennis Albrecht

*Attorney, Agent, or Firm*—Milton L. Honig; James J. Farrell

[57] ABSTRACT

High-concentration (60–80% active matter) detergent compositions in the form of stable, translucent, mobile gels based on dialkyl sulphosuccinates and alkyl ether sulphates, and containing a lower alcohol and water, are disclosed. For stability, the ratio of lower alcohol to water should be below a certain critical value that varies with the total active detergent level.

17 Claims, No Drawings

DETERGENT COMPOSITIONS

This is a continuation application of Ser. No. 727,498, filed Apr. 26, 1985, now abandoned.

The present invention relates to foaming detergent compositions in gel form, based on dialkyl sulphosuccinates and alkyl ether sulphates, and containing relatively high concentrations of active detergent.

GB Pat. No. 1 429 637 (Unilever) discloses liquid and powdered detergent compositions having excellent foaming properties and containing $C_7$–$C_9$ dialkyl sulphosuccinates together with alkyl sulphates or alkyl ether sulphates. Although it is stated that the concentration of active detergent may range from 5 to 100%, the range of 10 to 60% is preferred and the highest concentration exemplified for a liquid is 40%.

GB Pat. No. 2 130 238A (Unilever), published on 31 May 1984, discloses liquid detergents, having active detergent levels of from 2 to 60% by weight, based on dialkyl sulphosuccinates in combination with certain optimum alkyl ether sulphates containing 20% or less material of a chain length of $C_{14}$ or above.

Difficulties have been experienced when attempting to formulate liquid detergents of high concentration from this combination of detergent-active materials. At concentrations above about 50% by weight it has proved difficult to obtain single-phase isotropic liquids stable over a reasonable temperature range and having acceptable viscosities. Frequently phase separation will occur, even when large quantities of urea are present as a hydrotrope, and when a single phase system is obtained its cloud point tends to be too high.

In our copending application of even date (Case C.3009) there are described and claimed isotropic liquid detergent compositions containing high levels (60 to 80% by weight) of dialkyl sulphosuccinates and alkyl ether sulphates, and relatively high levels of a lower alcohol such as ethanol. To avoid phase separation the alcohol to water ratio must be above a certain critical value, which increases with active detergent level, and for the particular system studied ranges from about 0.45 at 60% active detergent to about 0.6 at 70% active detergent. When the alcohol to water ratio falls below this critical value, two-phase compositions are obtained.

We have now discovered that if the alcohol to water is reduced much further it is possible once again to obtain stable compositions, in the form of gels. This represents an alternative approach to the formulation of these high-active-detergent products. The gels are stable, translucent and attractive in appearance.

The present invention accordingly provides a homogeneous foaming detergent composition in gel form consisting essentially of (a) from 60 to 80% by weight of an active detergent system consisting essentially of

[i] a water-soluble salt of a $C_3$–$C_{12}$ dialkyl ester of sulphosuccinic acid in which the alkyl groups may be the same or different,

[ii] a $C_{10}$–$C_{18}$ alkyl ether sulphate, the ratio of [i] to [ii] being from 4:1 to 0.5:1, and

[iii] optionally a nonionic detergent, in an amount not exceeding 15% by weight of the whole composition, (b) a $C_2$–$C_3$ mono- or polyhydric alcohol, and (c) water and minor ingredients to 100%, the ratio of (b) to water being below a critical value g above which separation into two phases occurs.

The total active detergent concentration in the composition of the invention is preferably within the range of from 60 to 76% by weight.

The compositions of the invention are non-Newtonian fluids and their viscosities are dependent on applied shear. At 25° C. and a shear rate of 20 $s^{-1}$ the viscosity, as measured with the Haake viscometer, preferably ranges from 1000 to 3500 cp, more preferably from 1500 to 3000 cp, and at a shear rate of 80 $s^{-1}$ the preferred range is from 700 to 1300 cp, more preferably from 800 to 1200 cp. Above the maximum figures the gels are so rigid that handling becomes difficult, and aeration during manufacture can also be a problem.

In the composition of the invention the active detergent system contains two essential ingredients. The first is a water-soluble salt of a dialkyl ester of sulphosuccinic acid, hereinafter referred to for simplicity as a dialkyl sulphosuccinate.

The detergent-active dialkyl sulphosuccinates used in the compositions of the invention are compounds of the formula I:

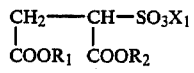

wherein each of $R_1$ and $R_2$, which may be the same or different, represents a straight-chain or branched-chain alkyl group having from 3 to 12 carbon atoms, preferably from 4 to 10 carbon atoms, and advantageously from 6 to 8 carbon atoms, and $X_1$ represents a solubilising cation, that is to say, any cation yielding a salt of the formula I sufficiently soluble to be detergent-active. The solubilising cation $X_1$ will generally be monovalent, for example, alkali metal, especially sodium.

The alkyl groups $R_1$ and $R_2$ are preferably straight-chain or (in mixtures) predominantly straight-chain.

The dialkyl sulphosuccinate component of the composition of the invention may if desired be constituted by a mixture of materials of different chain lengths, of which the individual dialkyl sulphosuccinates themselves may be either symmetrical (both alkyl groups the same) or unsymmetrical (with two different alkyl groups).

The present invention is of especial applicability to compositions containing dialkyl sulphosuccinate material of more than one chain length.

According to a preferred embodiment of the invention, the dialkyl sulphosuccinate used is a mixture of symmetrical and unsymmetrical materials. Such a mixture may conveniently be derived from a mixture of two or more aliphatic alcohols ($R_1OH$, $R_2OH$). The conversion of alcohol mix to dialkyl sulphosuccinate may be carried out by reaction with maleic anhydride followed by bisulphite addition. Dialkyl sulphosuccinate mixtures of this type are disclosed and claimed in GB Pat. No. 2 108 520A (Unilever) and GB Pat. No. 2 133 793A (Unilever). Of especial interest are dialkyl sulphosuccinates and mixtures thereof having $C_6$, $C_7$ and $C_8$ alkyl groups. $C_6/C_8$ unsymmetrical dialkyl sulphosuccinates are described and claimed in GB Pat. No. 2 105 325A, and mixtures of dioctyl and dihexyl suphosuccinates with other surfactants are described and claimed in GB Pat. No. 2 104 913A (Unilever).

The concentration of the dialkyl sulphosuccinate component in the whole composition is preferably within the range of from 20 to 65% by weight, more preferably within the range of from 25 to 55% by weight.

The second essential ingredient of the active detergent system of the composition of the invention is an alkyl ether sulphate. These anionic detergents are materials of the general formula II $$R_3—O—(CH_2CH_2O)_n—SO_3X_2 \quad (II)$$

wherein $R_3$ is an alkyl group having from 10 to 18 carbon atoms and $X_2$ is a solubilising cation, for example, alkali metal, ammonium, substituted ammonium or magnesium. The average degree of ethoxylation n preferably ranges from 1 to 12, more preferably from 1 to 8 and desirably from 1 to 5. In any given alkyl ether sulphate a range of differently ethoxylated materials, and some unethoxylated material (alkyl sulphate), will be present and the value of n represents an average. If desired, additional alkyl sulphate may be admixed with the alkyl ether sulphate to give a mixture in which the ethoxylation distribution is more weighted towards lower values.

The amount of alkyl ether sulphate present in the composition of the invention is preferably within the range of from 12 to 55% by weight, more preferably from 15 to 30% by weight.

According to a preferred embodiment of the invention, the alkyl ether sulphate contains 20% or less by weight of material of chain length $C_{14}$ and above. As previously indicated, the use of this alkyl ether sulphate together with dialkyl sulphosuccinates in lower-concentration liquid detergents is described and claimed in GB Pat. No. 2 130 238A (Unilever). In the alkyl ether sulphate the content of $C_{14}$ and longer-chain material is advantageously less than 10% by weight, and use of a material substantially free of $C_{14}$ and above alkyl groups is especially preferred. An example of such a material is Dobanol (Trade Mark) 23 ex Shell, based on a mixture of approximately 50% each of $C_{12}$ and $C_{13}$ alcohols. The optimum average degree of ethoxylation for alkyl ether sulphates of this preferred type appears to be 2 or 3. In the Examples, we have used Dobanol 23-3A, which has an average degree of ethoxylation of 3.

The two essential components [i] and [ii] of the active detergent system are used in a weight ratio of from 4:1 to 0.5:1, preferably 2.5:1 to 1.5:1.

As previously indicated, one or more nonionic surfactants may optionally be present in the composition of the invention, in an amount insufficient to cause instability. The preferred level for the nonionic surfactant will depend on the type of surfactant concerned, but will generally be below 15% by weight of the whole composition.

The nonionic surfactant may advantageously be selected from the following classes:

(a) $C_{10}$–$C_{18}$ alkyl di($C_2$–$C_3$ alkanol)amides, preferably $C_{12}$–$C_{14}$ alkyl diethanolamides, for example, Empilan (Trade Mark) LDE and CDE ex Albright & Wilson and Ninol (Trade Mark) P 621 ex Stepan Chemical Company; and (b) ethoxylated $C_8$–$C_{12}$ primary aliphatic alcohols, for example, Dobanol (Trade Mark) 91-8 ex Shell ($C_9$–$C_{11}$ alcohol, 8 EO).

Mixtures of two or more nonionic surfactants selected from these classes may also be used.

Nonionic surfactants of type (a) may be included at levels of up to 15% by weight (of the whole composition) without causing phase separation. The level at which sufactants of type (b) can be tolerated without causing phase separation appears to depend of the alcohol level.

Detergent compositions containing dialkyl sulphosuccinates together with the diethanolamides of class (a) are described and claimed in GB Pat. No. 2 130 236A (Unilever), published on 31 May 1984.

At the high active matter concentrations with which the invention is concerned, there is little room for other ingredients and these must be chosen with especial care. The predominant residual ingredient is preferably water, and clearly sufficient water must be present to give a low enough alcohol to water ratio. This will include any water inherently present in the detergent-active agents and the lower alcohol. The compositions preferably contain at least 15% by weight of water, more preferably at least 18%.

The composition of the invention also contains a lower aliphatic alcohol, preferably isopropanol, glycerol or, above all, ethanol. The present invention is based on the discovery that the ratio of alcohol to water is of critical importance in the avoidance of phase separation.

The critical value g below which the alcohol to water ratio must lie for stability varies with the total active detergent level. It is possible, too, that it will vary slightly with dialkyl sulphosuccinate chain length, the ratio of dialkyl sulphosuccinate to alkyl ether sulphate, the countercation and the lower alcohol used. The values of g quoted in the present specification have been determined for a particular dialkyl sulphosuccinate mix containing $diC_6$,$diC_8$ and $C_6/C_8$ material, all in sodium salt form. The mixture was prepared as described in the aforementioned GB Pat. No. 2 108 520A (Unilever), by reacting a mixture of n-hexanol and n-octanol with maleic anhydride and subjecting the resulting mixture of dialkyl maleates to bisulphite addition. The starting alcohols were used in substantially equimolar proportions to give a so-called "statistical mixture" containing the $diC_6$, $diC_8$ and $C_6/C_8$ sulphosuccinates in molar proportions of approximately 1:1:2.

This mixture was used in conjunction with an alkyl ether sulphate in ammonium salt form, at a weight ratio of 2:1, and the lower alcohol used was ethanol. Precise details of all materials used are given in the Examples below.

For this sytem, the experimental work described in the Examples indicated that the critical ratio g lay within the following limits:

| Total active detergent (%) | Critical ratio "g" |
|---|---|
| 60 | between 0.25 and 0.28 |
| 63 | between 0.29 and 0.31 |
| 66 | between 0.33 and 0.34 |
| 68 | between 0.34 and 0.37 |
| 70 | between 0.37 and 0.41 |
| 72 | between 0.30 and 0.33 |
| 74 | between 0.28 and 0.31 |
| 76 | between 0.24 and 0.26 |

It will be seen that there appears to be no simple linear relationship: the value of g rises with increasing active detergent level to a maximum value at about 70% active detergent, and then falls again.

In general it would appear that the ratio of lower alcohol to water should not exceed 0.41, and that it will always be less than a critical value g lying between 0.25 and 0.41. The alcohol to water ratio in the gels of the invention is preferably in the range of from 0.1 to 0.37.

In absolute terms, the level of the alcohol (b) in the compositions of the invention preferably does not exceed 10.5% by weight, and more preferably does not exceed 9% by weight. A preferred weight range for the alcohol level is from 2 to 10.5%, preferably from 2 to 9%, and more preferably from 3 to 8.5%.

It is possible in principle that this component might be omitted completely, but it is difficult entirely to eliminate residual alcohol in the detergent-active raw materials used. Both dialkyl sulphosuccinates and alkyl ether sulphates normally contain ethanol, but the levels present can generally be reduced by distillation. However, when the alcohol content is very low the gels tend to be very rigid and aerated, and an alcohol content of at least 2% by weight appears to be desirable in order to obtain a sufficiently mobile gel. The upper limit on alcohol content is of course determined by the need to avoid phase separation, but the gels right at the stability boundary may perhaps be excessively mobile and it may be preferable to use a slightly lower alcohol level. For any particular dialkyl sulphosuccinate/alkyl ether sulphate mixture the alcohol level giving optimum gel properties may readily be determined by routine experiment: this will decrease as the active detergent level increases.

The compositions of the invention may also contain the usual minor ingredients well-known to those skilled in the art, for example, colouring, perfume and germicides. These in total will not generally constitute more than about 2% by weight of the whole composition.

The invention is further illustrated by the following non-limiting Examples.

EXAMPLES

In the following Examples, as previously indicated, the dialkyl sulphosuccinate used was the $C_6/C_8$ statistical mixture referred to previously and described in the aforementioned GB Pat. No. 2 108 520 (Unilever): this is a mixture of approximately 25 mole % of di-n-hexyl sulphosuccinate, 25 mole % of di-n-octyl sulphosuccinate and 50 mole % of n-hexyl n-octyl sulphosuccinate (all sodium salts). It was in the form of an approximately 80% paste prepared as described in EP Pat. No. 140 710A (Unilever), published on 8 May 1985. This material contained a low level of electrolytic impurities; in the individual Examples the total electrolyte levels of the compositions are given.

As previously indicated, the alkyl ether sulphate used was Dobanol 23-3A ex Shell ($C_{12}$–$C_{13}$, 3 EO, ammonium salt) in the form of an approximately 60% aqueous solution containing some ethanol and some electrolyte. These have been included in the total ethanol and electrolyte levels quoted.

The lower alcohol used was ethanol, in the form of industrial methylated spirit (90.6% by weight ethanol), but the figures quoted are for actual ethanol content. The figures quoted for the water content of the various compositions include that derived from the detergent-active raw materials themselves and from the industrial methylated spirit, and have been calculated by subtraction from 100%.

All ingredient levels are quoted, in weight %, as the nominal figures for 100% material.

EXAMPLES 1 to 4

Detergent compositions containing 60% active matter were prepared from the following ingredients.

| | 1 | 2 | 3 | 4 | A | B |
|---|---|---|---|---|---|---|
| Dialkyl sulphosuccinate | 40 | 40 | 40 | 40 | 40 | 40 |
| Ether sulphate | 20 | 20 | 20 | 20 | 20 | 20 |
| Ethanol | 6.1 | 6.7 | 7.3 | 7.9 | 8.5 | 10.3 |
| Electrolytic impurities | 0.42 | 0.42 | 0.42 | 0.42 | 0.42 | 0.42 |
| Water (to 100%) | 33.48 | 32.88 | 32.28 | 31.66 | 31.08 | 29.28 |
| Ethanol to water ratio | 0.18 | 0.20 | 0.23 | 0.25 | 0.28 | 0.35 |

At room temperature, Compositions 1 and 2 were stable mobile gels. Composition 3 was a more mobile gel showing a slight tendency towards phase separation, and Composition 4 was an extremely mobile gel. Comparative Compositions A and B were unstable and separated into two liquid phases. It will be seen that the critical ethanol to water ratio for this system lies between 0.25 and 0.28.

EXAMPLE 5

The effect of partially replacing the alkyl ether sulphate of Composition 1 by a nonionic surfactant was investigated. The nonionic surfactant was Dobanol 91-8 ex Shell, identified previously.

| | 5 | C | D | E |
|---|---|---|---|---|
| Dialkyl sulphosuccinate | 40.0 | 40.0 | 40.0 | 40.0 |
| Ether sulphate | 15.0 | 13.33 | 10.0 | 6.67 |
| Nonionic surfactant | 5.0 | 6.67 | 10.0 | 13.33 |
| Ethanol | 6.1 | 6.1 | 6.1 | 6.1 |
| Electrolytic impurities | 0.36 | 0.33 | 0.29 | 0.24 |
| Water (to 100%) | 33.54 | 33.57 | 33.61 | 33.66 |
| Ethanol:water ratio | 0.18 | 0.18 | 0.18 | 0.18 |

Composition 5 was a fairly viscous but mobile gel, showing slight signs of phase separation on room temperature storage; evidently this composition represents the maximum level of this particular nonionic surfactant that can be incorporated at this ethanol level without causing instability. Comparative Compositions C, D and E were all unstable and contained two or more immiscible liquid phases.

EXAMPLES 6 to 11

Further compositions containing 60% active matter were prepared from the ingredients shown below. The lauric diethanolamide was Empilan LDE ex Albright & Wilson identified previously.

| | 6 | 7 | 8 | 9 | 10 | 11 |
|---|---|---|---|---|---|---|
| Dialkyl sulphosuccinate | 35.0 | 35.0 | 35.0 | 35.0 | 35.0 | 35.0 |
| Ether sulphate | 25.0 | 21.0 | 19.5 | 17.5 | 15.5 | 14.0 |
| Lauric diethanolamide | — | 4.0 | 5.5 | 7.5 | 9.5 | 11.0 |
| Ethanol | 6.7 | 6.7 | 6.7 | 6.7 | 6.7 | 6.7 |
| Electrolytic impurities | 0.47 | 0.42 | 0.40 | 0.37 | 0.34 | 0.32 |
| Water (to 100%) | 32.86 | 32.91 | 32.93 | 32.96 | 32.99 | 33.01 |
| Ethanol to | 0.20 | 0.20 | 0.20 | 0.20 | 0.20 | 0.20 |

-continued

| | 6 | 7 | 8 | 9 | 10 | 11 |
|---|---|---|---|---|---|---|
| water ratio | | | | | | |

All six compositions were stable, fairly thick but mobile gels. It is clear that relatively high levels of lauric diethanolamide may be tolerated in this system.

EXAMPLES 12 to 14

Detergent compositions containing 63% active matter were prepared from the following ingredients:

| | 12 | 13 | 14 | F | G |
|---|---|---|---|---|---|
| Dialkyl sulphosuccinate | 42 | 42 | 42 | 42 | 42 |
| Ether sulphate | 21 | 21 | 21 | 21 | 21 |
| Ethanol | 7.3 | 8.0 | 8.3 | 8.5 | 11.3 |
| Electrolytic impurities | 0.45 | 0.45 | 0.45 | 0.45 | 0.45 |
| Water (to 100%) | 29.25 | 28.55 | 28.30 | 28.05 | 25.25 |
| Ethanol to water ratio | 0.25 | 0.28 | 0.29 | 0.30 | 0.45 |

At room temperature, Composition 12 was a stable, fairly mobile gel, Composition 13 was a stable mobile gel, and composition 14 was a highly mobile gel. Comparative Compositions F and G were unstable and separated into two liquid phases. It will be seen that the critical ethanol to water ratio for this system lies between 0.29 and 0.31.

EXAMPLES 15 to 18

Detergent compositions containing 66% active matter were prepared from the following ingredients:

| | 15 | 16 | 17 | 18 | H | J |
|---|---|---|---|---|---|---|
| Dialkyl sulphosuccinate | 44 | 44 | 44 | 44 | 44 | 44 |
| Ether sulphate | 22 | 22 | 22 | 22 | 22 | 22 |
| Ethanol | 6.7 | 7.3 | 8.0 | 8.3 | 8.5 | 10.3 |
| Electrolytic impurities | 0.47 | 0.47 | 0.47 | 0.47 | 0.47 | 0.47 |
| Water (to 100%) | 26.83 | 26.23 | 25.53 | 25.28 | 25.03 | 23.23 |
| Ethanol to water ratio | 0.25 | 0.28 | 0.31 | 0.33 | 0.34 | 0.44 |

At room temperature, Compositions 15 and 16 were stable thick mobile gels, Composition 17 was a stable slow-flowing gel, and Composition 18 was a fairly viscous but mobile gel. Comparative Compositions H and J were unstable and separated into two liquid phases. It will be seen that the critical ethanol to water ratio for this system lies between 0.33 and 0.34.

EXAMPLES 19 to 22

Detergent compositions containing 68% active matter were prepared from the following ingredients:

| | 19 | 20 | 21 | 22 | K | L |
|---|---|---|---|---|---|---|
| Dialkyl sulphosuccinate | 45.33 | 45.33 | 45.33 | 45.33 | 45.33 | 45.33 |
| Ether sulphate | 22.67 | 22.67 | 22.67 | 22.67 | 22.67 | 22.67 |
| Ethanol | 6.9 | 7.4 | 7.7 | 8.0 | 8.5 | 10.3 |
| Electrolytic impurities | 0.48 | 0.48 | 0.48 | 0.48 | 0.48 | 0.48 |
| Water (to 100%) | 24.62 | 24.09 | 23.83 | 23.52 | 23.02 | 21.22 |
| Ethanol to water ratio | 0.28 | 0.31 | 0.32 | 0.34 | 0.37 | 0.49 |

At room temperature, Composition 19 was a stable mobile gel; Composition 20 was a thick gel that would flow; Composition 21 was a thick, rather viscous gel; and Composition 22 was a mobile gel showing a slight tendency to phase separation. Comparative Compositions K and L were unstable and separated into two liquid phases. It will be seen that the critical ethanol to water ratio for this system lies between 0.34 and 0.37.

EXAMPLES 23 to 27

Detergent compositions containing 70% active matter were prepared from the following ingredients:

| | 23 | 24 | 25 | 26 | 27 | M |
|---|---|---|---|---|---|---|
| Dialkyl sulphosuccinate | 46.67 | 46.67 | 46.67 | 46.67 | 46.67 | 46.67 |
| Ether sulphate | 23.33 | 23.33 | 23.33 | 23.33 | 23.33 | 23.33 |
| Ethanol | 7.1 | 7.3 | 7.6 | 7.7 | 8.0 | 8.5 |
| Electrolytic impurities | 0.50 | 0.49 | 0.49 | 0.50 | 0.50 | 0.50 |
| Water (to 100%) | 22.40 | 22.19 | 21.96 | 21.82 | 21.50 | 21.00 |
| Ethanol to water ratio | 0.32 | 0.33 | 0.34 | 0.35 | 0.37 | 0.41 |

At room temperature, Composition 23 was a stable, slow-flowing gel; Composition 24 was a thick, somewhat viscous gel; Compositions 25 and 26 were fairly thick mobile gels; and Composition 27 was a mobile gel showing a slight tendency to phase separation. Comparative Composition M was unstable and separated into two liquid phases. It will be seen that the critical ethanol to water ratio for this system lies at between 0.37 and 0.41.

EXAMPLE 28 to 30

Detergent compositions containing 72% active matter were prepared from the following ingredients:

| | 28 | 29 | 30 | 31 | N | P | Q |
|---|---|---|---|---|---|---|---|
| Dialkyl sulphosuccinate | 48.0 | 48.0 | 48.0 | 48.0 | 48.0 | 48.0 | 48.0 |
| Ether sulphate | 24.0 | 24.0 | 24.0 | 24.0 | 24.0 | 24.0 | 24.0 |
| Ethanol | 4.9 | 5.6 | 6.0 | 6.4 | 6.9 | 7.3 | 8.5 |
| Electrolytic impurities | 0.51 | 0.51 | 0.51 | 0.51 | 0.51 | 0.51 | 0.51 |
| Water (to 100%) | 22.59 | 21.87 | 21.50 | 21.09 | 20.65 | 20.19 | 18.99 |
| Ethanol to water ratio | 0.22 | 0.26 | 0.28 | 0.30 | 0.33 | 0.36 | 0.45 |

At room temperature, Composition 28 was a stable, mobile gel, and Compositions 29 and 30 were fairly viscous mobile gels; and Composition 31 was a very mobile gel showing some tendency towards phase separation. Comparative Compositions N, P and Q were unstable and separated into two liquid phases. It will be seen that the critical ethanol to water ratio for this system lies between 0.30 and 0.33, and is probably nearer the lower figure.

EXAMPLE 32 to 36

Detergent compositions containing 74% active matter were prepared from the following ingredients:

| | 32 | 33 | 34 | 35 | 36 | R | S |
|---|---|---|---|---|---|---|---|
| Dialkyl sulphosuccinate | 49.33 | 49.33 | 49.33 | 49.33 | 49.33 | 49.33 | 49.33 |
| Ether sulphate | 24.67 | 24.67 | 24.67 | 24.67 | 24.67 | 24.67 | 24.67 |
| Ethanol | 3.1 | 4.0 | 4.5 | 4.9 | 5.5 | 6.0 | 6.4 |
| Electrolytic impurities | 0.52 | 0.52 | 0.52 | 0.52 | 0.52 | 0.52 | 0.52 |
| Water (to 100%) | 22.38 | 21.47 | 20.48 | 20.58 | 19.98 | 19.48 | 19.08 |
| Ethanol to water ratio | 0.14 | 0.19 | 0.21 | 0.24 | 0.28 | 0.31 | 0.34 |

At room temperature, Composition 32 was a stable, slow-flowing gel; Composition 33 was a very thick gel; Composition 34 was a rather viscous thick gel; and Compositions 35 and 36 were mobile, thick gels. Comparative Compositions R and S were unstable and separated into two liquid phases. It will be seen that the critical ethanol to water ratio for this system lies between 0.28 and 0.31.

EXAMPLE 37 to 40

Detergent compositions containing 76% active matter were prepared from the following ingredients:

| | 37 | 38 | 39 | 40 | T |
|---|---|---|---|---|---|
| Dialkyl sulphosuccinate | 50.67 | 50.67 | 50.67 | 50.67 | 50.67 |
| Ether sulphate | 25.33 | 25.33 | 25.33 | 25.33 | 25.33 |
| Ethanol | 3.2 | 3.6 | 4.1 | 4.5 | 4.9 |
| Electrolytic impurities | 0.54 | 0.54 | 0.54 | 0.54 | 0.54 |
| Water (to 100%) | 20.26 | 19.91 | 19.42 | 18.87 | 18.56 |
| Ethanol to water ratio | 0.16 | 0.18 | 0.21 | 0.24 | 0.26 |

At room temperature, Composition 37 was a very thick, aerated gel that was just mobile, and Compositions 38, 39 and 40 were fairly mobile, thick gels. Comparative Composition T was unstable and separated into two liquid phases. It will be seen that the critical ethanol to water ratio for this system lies between 0.24 and 0.26.

EXAMPLE 41

This Example shows the viscosities of some compositions of the invention at different shear rates. Viscosities were measured at 20° C. using a Haake viscometer. All the compositions examined had similar ethanol levels of 7.3% by weight, as may be seen from the relevant earlier Examples. The results were as follows:

| Composition | Total active detergent | Viscosity (cp) at a shear rate ($s^{-1}$) of | | | | | |
|---|---|---|---|---|---|---|---|
| | | 5.03 | 10.06 | 20.12 | 40.25 | 80.50 | 161.00 |
| 12 | 63 | 4814 | 3344 | 1976 | 1254 | 817 | 551 |
| 16 | 66 | 6080 | 3952 | 2356 | 1406 | 931 | 665 |
| 24 | 70 | 7296 | 4408 | 2660 | 1634 | 1102 | 751 |

It will be seen that at all shear rates the viscosity increases steadily with increasing active detergent level.

EXAMPLE 42

This Example shows the effect of ethanol level on viscosity at a constant active detergent level of 66%.

It will be seen that, as may be expected, the viscosity decreases as the ethanol level is raised.

| Composition | Ethanol level | Viscosity (cp) at a shear rate ($s^{-1}$) of | | | | | |
|---|---|---|---|---|---|---|---|
| | | 5.03 | 10.06 | 20.12 | 40.25 | 80.50 | 161.00 |
| 15 | 6.7 | 7904 | 4712 | 2736 | 1710 | 1064 | 684 |

-continued

| Composition | Ethanol level | Viscosity (cp) at a shear rate ($s^{-1}$) of | | | | | |
|---|---|---|---|---|---|---|---|
| | | 5.03 | 10.06 | 20.12 | 40.25 | 80.50 | 161.00 |
| 16 | 7.3 | 6080 | 3952 | 2356 | 1406 | 931 | 665 |
| 17 | 8.0 | 4864 | 3192 | 1976 | 1254 | 874 | 608 |

I claim:

1. A homogeneous foaming detergent composition in gel form consisting essentially of (a) from 60 to 80% by weight of an active detergent system consisting essentially of (i) from 20 to 65% by weight of a water-soluble monovalent salt of a $C_3$–$C_{12}$ dialkyl ester of sulphosuccinic acid in which the alkyl groups may be the same or different, (ii) from 12 to 55% by weight of a monovalent salt of a $C_{10}$–$C_{18}$ alkyl ether sulphate, the ratio of [i] to [ii] being from 4:1 to 0.5:1, and (iii) optionally a nonionic detergent, in an amount insufficient to cause instability of the composition, (b) from 2 to 10.5% by weight of a $C_2$–$C_3$ mono- or polyhydric alcohol, and (c) water and minor ingredients to 100%, the ratio of alcohol (b) to water being below a critical value g which is selected for the given active detergent system as the value of said ratio above which separation into two phases occurs, said value being in the range of from 0.25 to 0.41 and being dependent on the total active detergent concentration.

2. A composition as claimed in claim 1, wherein the ratio of alcohol (b) to water is below 0.41.

3. A composition as claimed in claim 1, wherein the ratio of alcohol (b) to water is within the range of from 0.1 to 0.37.

4. A composition as claimed in claim 1, which contains at most 9% by weight of the alcohol (b).

5. A composition as claimed in claim 4, which contains from 2 to 9% by weight of the alcohol (b).

6. A composition as claimed in claim 4, which contains from 3 to 8.5% by weight of the alcohol (b).

7. A composition as claimed in claim 1, wherein the $C_2$–$C_3$ alcohol comprises ethanol.

8. A composition as claimed in claim 1, having a viscosity at 25° C. and 20 $s^{-1}$ within the range of from 1000 to 3500 cp.

9. A composition as claimed in claim 8, having a viscosity at 25° C. and 20 $s^{-1}$ within the range of from 1500 to 3000 cp.

10. A composition as claimed in claim 1, wherein the dialkyl sulphosuccinate (i) comprises material of at least two different alkyl chain lengths.

11. A composition as claimed in claim 10, wherein the dialkyl sulphosuccinate (i) comprises a mixture of symmetrical and unsymmetrical dialkyl sulphosuccinates.

12. A composition as claimed in claim 1, wherein the dialkyl sulphosuccinate (i) consists wholly or predominantly of straight-chain material.

13. A composition as claimed in claim 1, wherein the alkyl groups of the dialkyl sulphosuccinate (i) each have from 4 to 10 carbon atoms.

14. A composition as claimed in claim 13, wherein the alkyl groups of the dialkyl sulphosuccinate (i) each have from 6 to 8 carbon atoms.

15. A composition as claimed in claim 1, wherein the total active detergent concentration is within the range of from 63 to 76% by weight.

16. A composition as claimed in claim 1, wherein the ratio of dialkyl sulphosuccinate (i) to alkyl ether sulphate (ii) is within the range of from 2.5:1 to 1.5:1.

17. A composition as claimed in claim 1, which includes as an optional nonionic detergent a $C_{10}$–$C_{18}$ alkyl di($C_2$–$C_3$ alkanol)amide, in an amount not exceeding 15% by weight of the whole composition.

* * * * *